US006059635A

United States Patent [19]

Mizuno

[11] Patent Number: 6,059,635

[45] Date of Patent: May 9, 2000

[54] APPARATUS FOR GRINDING EYEGLASS LENS

[75] Inventor: Toshiaki Mizuno, Aichi, Japan

[73] Assignee: Nidek Co., Ltd., Aichi, Japan

[21] Appl. No.: 09/069,808

[22] Filed: Apr. 30, 1998

[30] Foreign Application Priority Data

Apr. 30, 1997 [JP] Japan ..... 9-127877

[51] Int. Cl.[7] ..... B24B 49/00

[52] U.S. Cl. ..... 451/5; 451/65

[58] Field of Search ..... 451/11, 5, 12, 451/14, 43, 65

[56] References Cited

U.S. PATENT DOCUMENTS

| | | | |
|---|---|---|---|
| 3,894,361 | 7/1975 | Georgiadis et al. | 51/101 LG |
| 4,945,684 | 8/1990 | Wada et al. | 451/5 |
| 5,053,971 | 10/1991 | Wood et al. | 451/5 X |
| 5,138,770 | 8/1992 | Matsuyama | 33/28 |
| 5,148,637 | 9/1992 | Byron | 451/5 |
| 5,210,695 | 5/1993 | Wood | 451/5 X |
| 5,217,335 | 6/1993 | Houchens, Jr. et al. | 451/5 X |
| 5,228,242 | 7/1993 | Matsuyama | 51/165.74 |
| 5,231,587 | 7/1993 | Frost | 451/5 X |
| 5,333,412 | 8/1994 | Matsuyama | 51/165.71 |
| 5,347,762 | 9/1994 | Shibata et al. | 451/15 |
| 5,371,974 | 12/1994 | Lecerf et al. | 451/5 |
| 5,775,973 | 7/1998 | Watanabe | 451/5 |

FOREIGN PATENT DOCUMENTS

| | | | |
|---|---|---|---|
| 3-20603 | 1/1991 | Japan | G01B 5/06 |
| 1 492 985 | 11/1977 | United Kingdom | B24B 9/14 |

*Primary Examiner*—David A. Scherbel
*Assistant Examiner*—Anthony Ojini
*Attorney, Agent, or Firm*—Sughrue, Mion, Zinn, Macpeak & Seas, PLLC

[57] ABSTRACT

An eyeglass lens grinding apparatus which is adapted to be operable with different arrangements of abrasive wheels using a smaller number of software programs that have to be made available separately and which can be managed easily. In the eyeglass lens grinding apparatus, a program having processing sequences associated with different types of abrasive wheels is stored, information about the arrangement of abrasive wheels and their mounting positions is entered, an applicable processing sequence is determined from said program on the basis of the entered information, and the processing of a workpiece lens is controlled on the basis of the determined processing sequence.

5 Claims, 10 Drawing Sheets

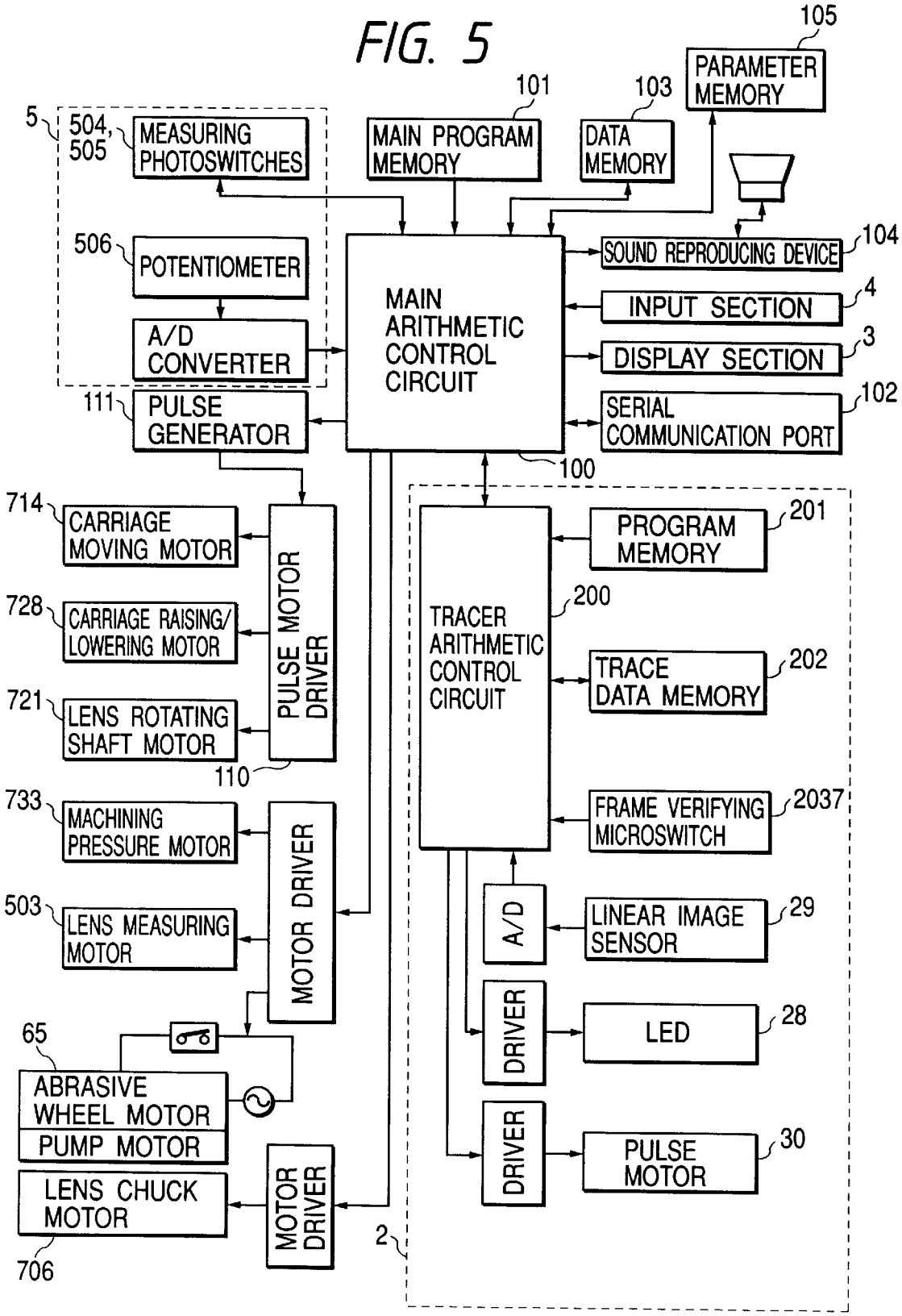
FIG. 5
5
504, 505
MEASURING PHOTOSWITCHES
506
POTENTIOMETER
A/D CONVERTER
111
PULSE GENERATOR
101
MAIN PROGRAM MEMORY
103
DATA MEMORY
105
PARAMETER MEMORY
MAIN ARITHMETIC CONTROL CIRCUIT
SOUND REPRODUCING DEVICE
104
INPUT SECTION
4
DISPLAY SECTION
3
SERIAL COMMUNICATION PORT
102
100
714
CARRIAGE MOVING MOTOR
728
CARRIAGE RAISING/ LOWERING MOTOR
721
LENS ROTATING SHAFT MOTOR
PULSE MOTOR DRIVER
110
733
MACHINING PRESSURE MOTOR
503
LENS MEASURING MOTOR
MOTOR DRIVER
65
ABRASIVE WHEEL MOTOR
PUMP MOTOR
LENS CHUCK MOTOR
706
MOTOR DRIVER
2
TRACER ARITHMETIC CONTROL CIRCUIT
200
PROGRAM MEMORY
201
TRACE DATA MEMORY
202
FRAME VERIFYING MICROSWITCH
2037
A/D
LINEAR IMAGE SENSOR
29
DRIVER
LED
28
DRIVER
PULSE MOTOR
30

FIG. 7

300

```
*****************************
*      SYSTEM SETTING MODE  *
*****************************
                 *EXIT : Press MENU
  SYSTEM MODE          : TYPE 2
  SERVER No.           : 00032
  ID No.               : 00001
  LMU CALIBRATION
  TRACER CALIBRATION
  WHEEL PARAMETER
  PROCESS COUNTER
  FRAME MEMORY CLEAR
  EEPROM INITIALIZE
```

301 302 303

FIG. 8

```
*****************************
*      WHEEL PARAMETER      *
*****************************
                 *EXIT : Press SELECT
  Plastic Rough position   25.00
  Glass Rough position     51.00
  Bevel position           53.00
  Flat position            68.50
  Plastic Flat position    70.50
```

302 305

FIG. 9

TYPE 2

| WHEEL ARRANGEMENT | WHEEL POSITION | PROCESSING SEQUENCE |
|---|---|---|
| PLASTIC POLYCARBONATE ROUGH ABRASIVE WHEEL | 25.00 | PLASTIC / ROUGH GRINDING SEQUENCE<br>POLYCARBONATE / ROUGH GRINDING SEQUENCE |
| GLASS ROUGH ABRASIVE WHEEL | 51.00 | GLASS / ROUGH GRINDING SEQUENCE |
| FINISHING ABRASIVE WHEEL | (BEVEL) 53.00 | PLASTIC / BEVEL-FINISHING SEQUENCE<br>POLYCARBONATE / BEVEL-FINISHING SEQUENCE<br>GLASS / BEVEL-FINISHING SEQUENCE |
| | (PLANE) 68.50 | PLASTIC / PLANE-FINISHING SEQUENCE<br>POLYCARBONATE / PLANE-FINISHING SEQUENCE |
| PLANE-POLISHING ABRASIVE WHEEL | 70.50 | PLASTIC / PLANE-POLISHING SEQUENCE<br>POLYCARBONATE / PLANE-FINISHING SEQUENCE |

FIG. 11

```
*************************************
*              SIZE ADJUSTMENT      *
*************************************

                    *EXIT: CHANGE SWITCH

ROUGH GRINDING SIZE (BEVEL):                0.00mm
ROUGH GRINDING SIZE (PLANE):                0.00mm
BEVEL SIZE ADJUSTMENT:                      0.00mm
PLANE SIZE ADJUSTMENT:                      0.00mm
POLISHING SIZE (PLASTIC / BEVEL):           0.00mm
POLISHING SIZE (PLASTIC / PLANE):           0.00mm
POLISHING SIZE (POLYCA. / BEVEL):           0.00mm
POLISHING SIZE (POLYCA. / PLANE):           0.00mm
FINISHING STOCK FOR POLISHING (PLASTIC):    0.00mm
FINISHING STOCK FOR POLISHING (POLYCA.):    0.00mm
```

302

FIG. 12

```
*************************************
*              BEVEL ADJUSTMENT     *
*************************************

BEVEL POSITION ADJUSTMENT:                  0.00mm
POLISHED-BEVEL POSITION ADJUSTMENT:         0.00mm

                    *EXIT: CHANGE SWITCH
```

302

APPARATUS FOR GRINDING EYEGLASS LENS

BACKGROUND OF THE INVENTION

The present invention relates to an eyeglass lens grinding apparatus for grinding an eyeglass lens so that it conforms to the shape of an eyeglass frame.

An eyeglass lens grinding apparatus is known that grinds the periphery of a rotating lens as it is pressed into contact with an abrasive wheel rotating at a high speed. In grinding the eyeglass lens, it is necessary to use an abrasive wheel suitable for the material of the lens to be processed, and it is also necessary to change the abrasive wheel depending on a specific processing stage such as rough grinding or finish grinding.

Most of the conventional standard arrangements of abrasive wheels have heretofore consisted of three abrasive wheels, i.e. a rough abrasive wheel for use on plastic lenses, a rough abrasive wheel for use on glass lenses and a finishing abrasive wheel. However, with the recent popularity of two-point frames and NYROL (nylon string rolled) frames, a growing demand has arisen for polishing (specular processing) in which a plane-processed lens edge is further polished to produce a mirror-like finish. In some countries, the standard arrangement of three abrasive wheels is sufficient but in other countries a special polishing abrasive wheel is required to provide a mirror-like finish in all edge portions of a lens including a bevelled part.

In order to meet these requirements, one may provide an arrangement of all abrasive wheels that are necessary to accomplish the desired processing operations. However, if all necessary abrasive wheels are made available, the total thickness of the wheels becomes so great that a substantial alteration in mechanism is required but this is impossible to realize with the existing apparatus.

Under the circumstances, manufacturers of lens grinding apparatus have had various types of machines available for different needs, such as one having the standard three-wheel arrangement, one having a four-wheel array including an additional abrasive wheel for polished-plane processing, and one dedicated to the processing of plastic lenses with a three-wheel arrangement capable of rough grinding, finishing and polishing. At the same time, the manufacturers have made available dedicated process control programs that are suited to the respective wheel arrangements.

However, the process control programs are often changed in order to improve the precision of lens processing operations or shorten the processing time. The change of process control programs has to be made for each wheel arrangement, requiring cumbersome program management.

In the process of manufacturing lens grinding apparatus, managing at plurality of software programs for different wheel arrangements is complicated and error-prone. In addition, changing abrasive wheels has not been easy on the part of operators of the apparatus.

SUMMARY OF THE INVENTION

The present invention has been accomplished under these circumstances and has as an object providing an eyeglass lens grinding apparatus which is adapted to be operable with different arrangements of abrasive wheels using a smaller number of software programs that have to be made available separately and which can be managed easily.

The present invention provides the followings:

(1) An eyeglass lens grinding apparatus for grinding an eyeglass lens so that it conforms to a shape of an eyeglass frame, said apparatus comprising:

storing means for storing therein a program having processing sequences associated with different types of abrasive wheels;

input means for entering information about an arrangement of abrasive wheels and their mounting positions;

processing sequence determining means for determining an applicable processing sequence from said program on the basis of the entered information; and processing control means for controlling processing of a lens on the basis of the determined processing sequence.

(2) An eyeglass lens grinding apparatus according to (1), wherein said processing sequence determining means has a table that relates the information about the arrangement of abrasive wheels and their mounting positions to the applicable processing sequence.

(3) An eyeglass lens grinding apparatus according to (1), further comprising:

parameter storage means for storing types of abrasive wheels and parametric values for their mounting positions, in relation to each of wheel arrangement types, wherein said input means includes:

type designating means for designating a wheel arrangement type; and parameter changing means for changing the parametric values stored in said parameter storage means for the designated wheel arrangement type, and wherein said processing sequence determining means determines the applicable processing sequence in association with the wheel arrangement type and parametric values stored in said parameter storage means.

(4) An eyeglass lens grinding apparatus according to (1), further comprising a parameter storage means for storing parametric values for adjusting the size of the lens after processing and its bevel position, in relation to each of wheel arrangement types; and a parameter changing means for changing the stored parametric values, and wherein said processing control means controls the processing of the lens based on the parametric values from said parameter storage means.

(5) An eyeglass lens grinding apparatus for grinding an eyeglass lens so that it conforms to a shape of an eyeglass frame, said apparatus comprising:

a first storage means for storing therein a program having processing sequences associated with different types of abrasive wheels;

a second storage means for storing therein mounting positions of respective abrasive wheels in relation to each of wheel arrangement types;

type designating means for designating a specific wheel arrangement type;

processing sequence determining means by which the mounting positions of respective wheels stored in said second storage means and an applicable processing sequence are determined from said program in accordance with the designated wheel arrangement type; and processing control means for controlling the processing of a lens on the basis of the determined processing sequence.

BRIEF DESCRIPTION OF THE DRAWINGS

In the accompanying drawings:

FIG. 5 shows the essential part of a block diagram for the electronic control system in the apparatus shown in FIG. 1;

FIG. 7 is an exemplary display of "SYSTEM SETTING MODE";

FIG. 8 is an exemplary display for setting the positions of the respective abrasive wheels of a four-wheel arrangement (TYPE 2);

FIG. 9 shows an exemplary table for the four-wheel arrangement (TYPE 2);

FIG. 11 is an exemplary parameter setting display for adjusting the lens size; and FIG. 12 is an exemplary parameter setting display for adjusting the bevel position of a lens.

DETAILED DESCRIPTION OF THE PREFERRED EMBODIMENTS

Figure 1:
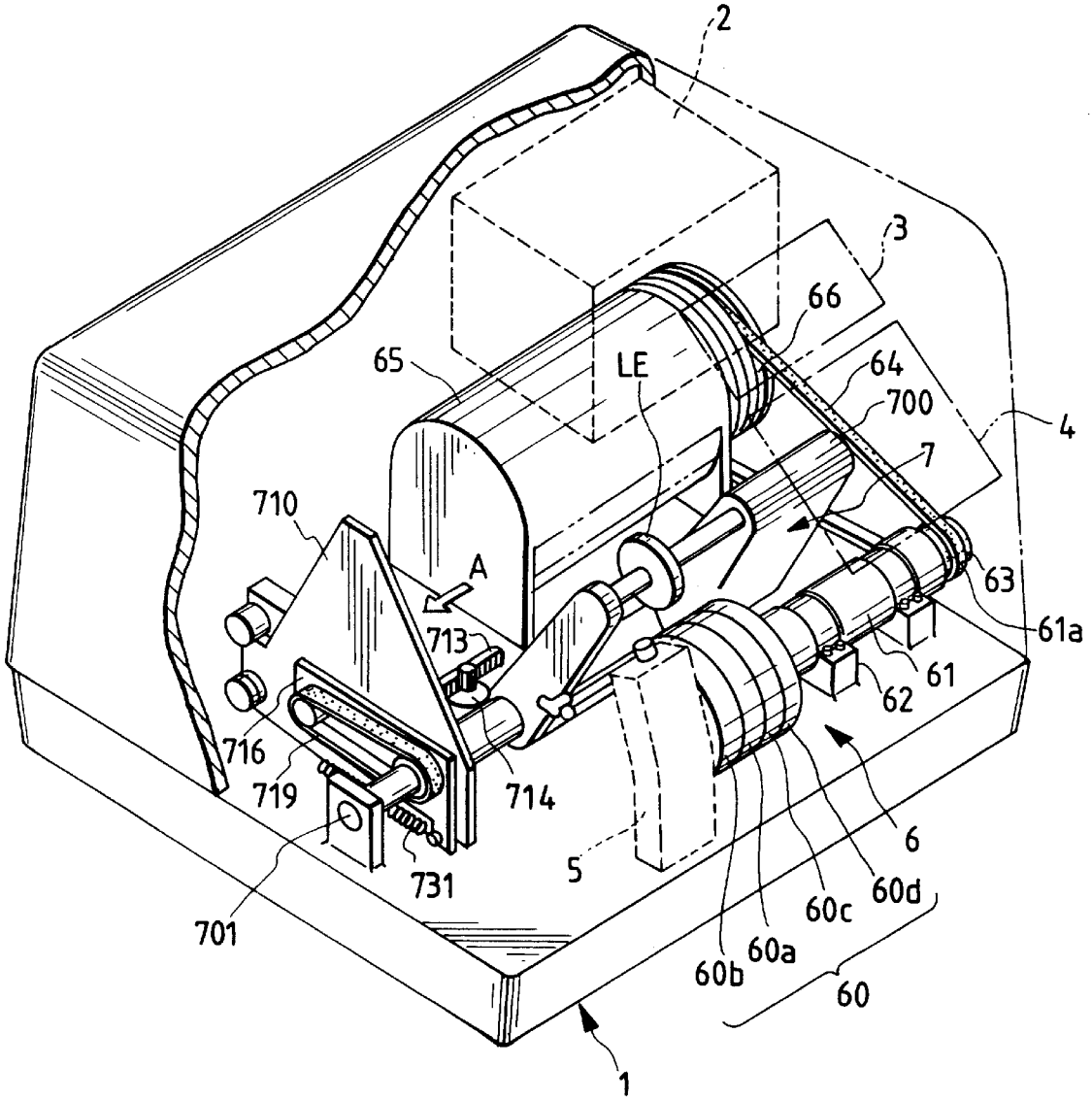
FIG. 1 is a perspective view showing the general layout of an eyeglass lens grinding apparatus according to an embodiment of the invention.

A preferred embodiment of the invention will now be described in detail with reference to the accompanying drawings. FIG. 1 is a perspective view showing the general layout of the eyeglass lens grinding apparatus of the invention. The reference numeral 1 designates a base, on which the components of the apparatus are arranged. The numeral 2 designates an eyeglass frame and template configuration measuring section, which is incorporated in the upper section of the grinding apparatus to obtain three-dimensional configuration data on the geometries of the eyeglass frame and the template. Arranged in front of the measuring section 2 are a display section 3 which displays the results of measurements, arithmetic operations, etc. in the form of either characters or graphics, and an input section 4 for entering data or feeding commands to the apparatus. Provided in the front section of the apparatus is a lens configuration measuring section 5 for measuring the configuration (edge thickness) of a lens to be processed.

The reference numeral 6 designates a lens grinding section, where an abrasive wheel group 60 is mounted on a rotating shaft 61*a* of a spindle unit 61, which is attached to the base 1. As an example, the abrasive wheel group 60 is made up of a rough abrasive wheel 60*a* for use on plastic lenses, a rough abrasive wheel 60*b* for use on glass lenses, a finishing abrasive wheel 60*c* for bevel (tapered edge) and plane processing operations and a polishing (specular processing) abrasive wheel 60*d*. With the abrasive wheel group 60 of this example, rough grinding for plastic, polycarbonate, and glass lenses, bevel processing for these lenses, plane processing for these lenses, and polishing for plastic and polycarbonate lenses are possible. In place of one or more of these lenses, a polished-finishing abrasive wheel for polished-bevel and polished plane processing operations, a rough abrasive wheel for use exclusively on polycarbonate lenses, a rough abrasive wheel having a large width and so on may be selectively mounted depending on a kind of lens material and a kind of required processing. Various selections are available as far as the sum of abrasive wheel widths falls within a permissible range.

The reference numeral 65 designates an AC motor, the rotational torque of which is transmitted through a pulley 66, a belt 64 and a pulley 63 mounted on the rotating shaft 61*a* to the abrasive wheel group 60 to rotate the same. Shown by 7 is a carriage section and 700 is a carriage.

Next, the layout of the major components of the apparatus will be described.

(A) Carriage section

Figure 2:
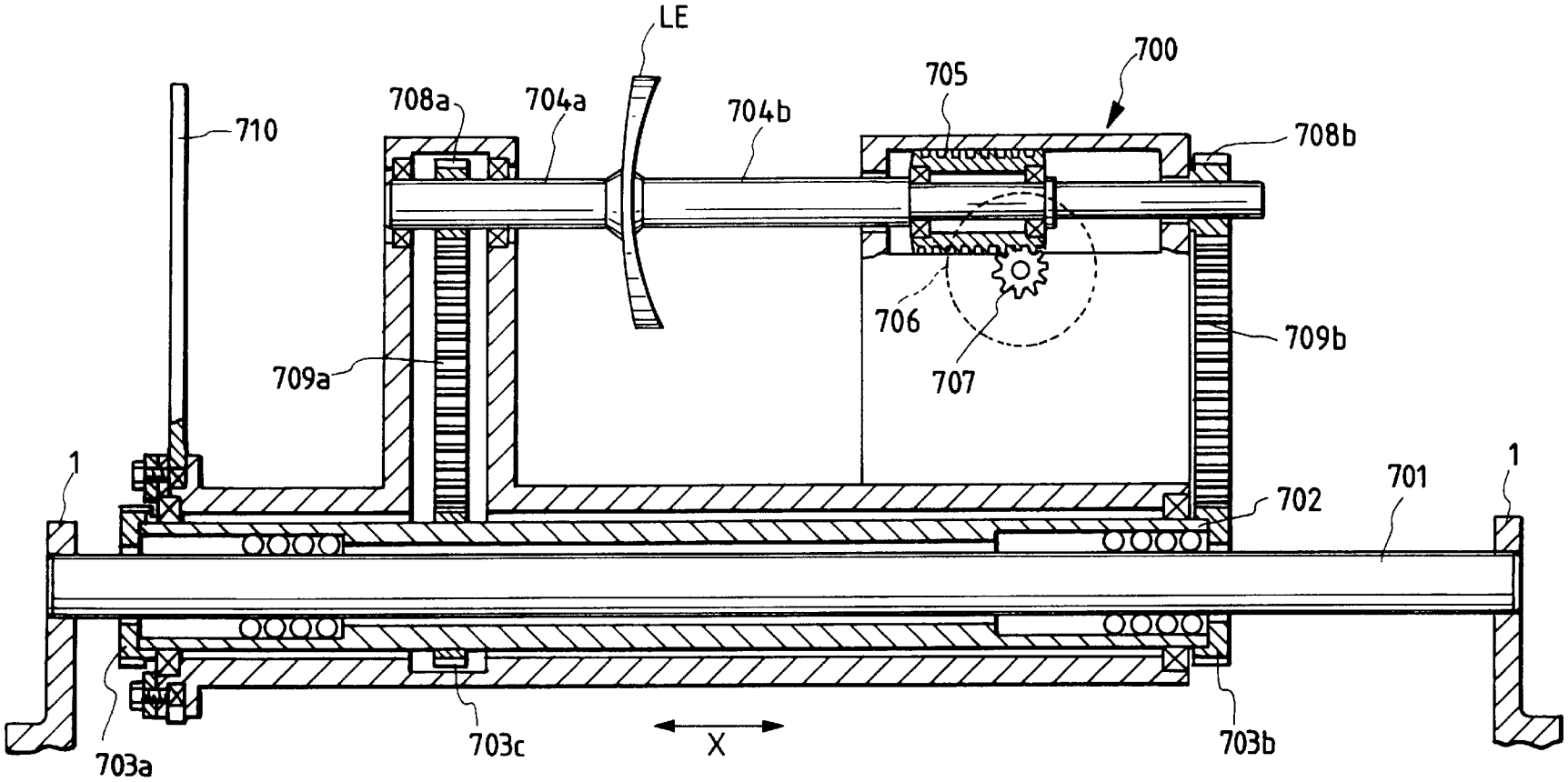
FIG. 2 is a sectional view illustrating the carriage in the apparatus shown in FIG. 1.
Figure 3:
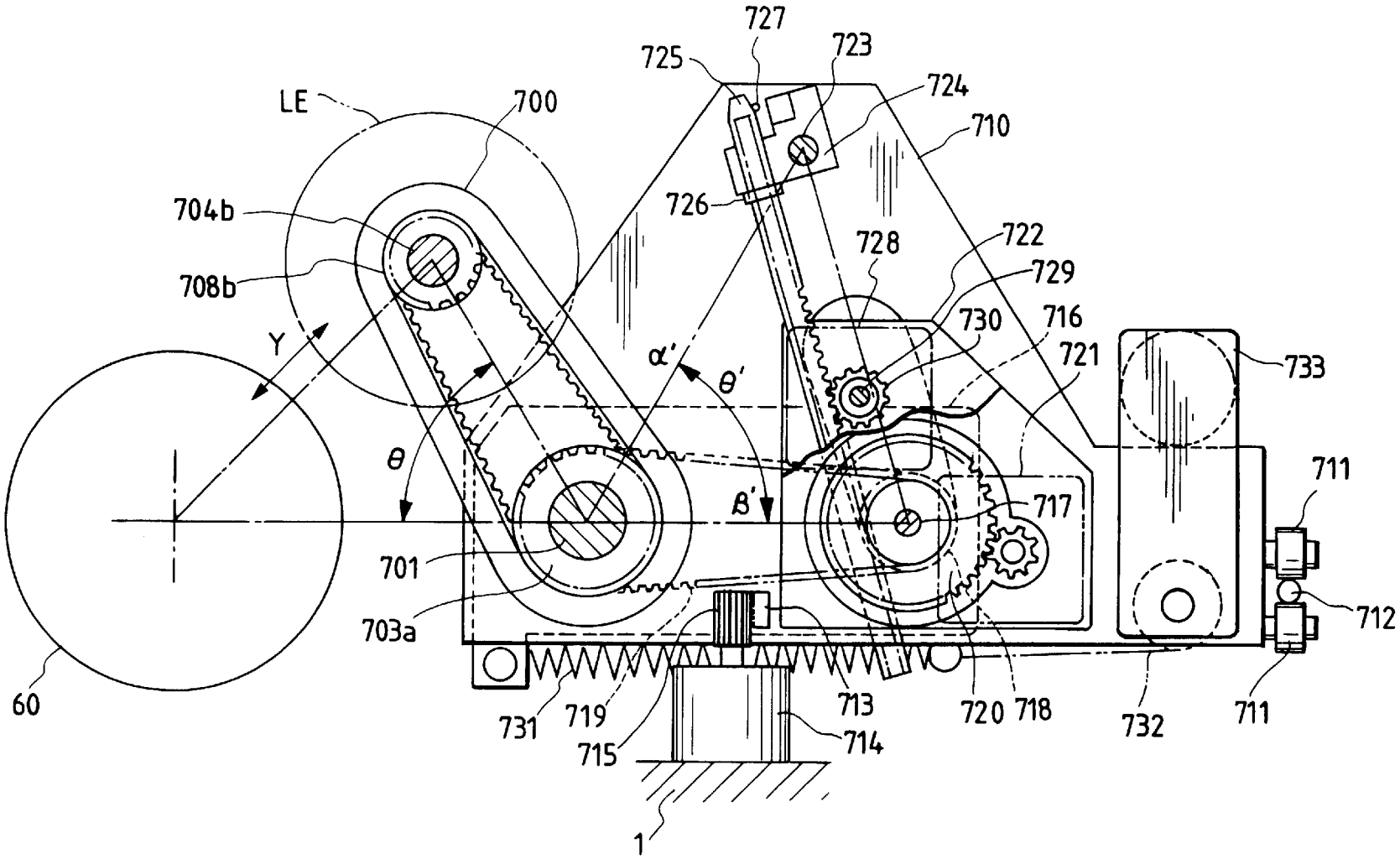
FIG. 3 is a section of a carriage drive mechanism as seen in the direction of arrow A in FIG. 2.

The construction of the carriage section will now be described with reference to FIGS. 1 to 3. FIG. 2 is a cross-sectional view of the carriage, and FIG. 3 is a diagram showing a drive mechanism for the carriage, as viewed in the direction of arrow A in FIG. 1.

A shaft 701 is secured on the base 1 and a carriage shaft 702 is rotatably and slidably supported on the shaft 701; the carriage 700 is pivotally supported on the carriage shaft 702. Lens rotating shafts 704*a* and 704*b* are coaxially and rotatably supported on the carriage 700, extending parallel to the shaft 701. The lens rotating shaft 704*b* is rotatably supported in a rack 705, which is movable in the axial direction by means of a pinion 707 fixed on the rotational shaft of a motor 706; as a result, the lens rotating shaft 704*b* is moved axially such that it is opened or closed with respect to the other lens rotating shaft 704*a*, thereby holding the lens LE in position (hereafter, the lens LE may be referred to as the lens to be processed).

A drive plate 716 is securely fixed at the left end of the carriage 700 and a rotational shaft 717 is rotatably provided on the drive plate 716, extending parallel to the shaft 701. A pulse motor 721 is fixed to the drive plate 716 by means of a block 722. The rotational torque of the pulse motor 721 is transmitted through a gear 720 attached to the right end of the rotating shaft 717, a pulley 718 attached to the left end of the rotating shaft 717, a timing belt 719 and a pulley 703*a* to the shaft 702. The rotational torque thus transmitted to the shaft 702 is further transmitted through a timing belts 709*a*, 709*b*, pulleys 703*b*, 703*c*, 708*a*, and 708*b* to the lens rotating shafts 704*a* and 704*b* so that the lens rotating shafts 704*a* and 704*b* rotate in synchronism.

An intermediate plate 710 has a rack 713 which meshes with a pinion 715 attached to the rotational shaft of a carriage moving motor 714, and the rotation of the pinion 715 causes the carriage 700 to move in an axial direction of the shaft 701.

The carriage 700 is pivotally moved by means of a pulse motor 728. The pulse motor 728 is secured to a block 722 in such a way that a round rack 725 meshes with a pinion 730 secured to the rotational shaft 729 of the pulse motor 728. The round rack 725 extends parallel to the shortest line segment connecting the axis of the rotational shaft 717 and that of the shaft 723 secured to the intermediate plate 710; in addition, the round rack 725 is held to be slidable with a certain degree of freedom between a correction block 724 which is rotatably fixed on the shaft 723 and the block 722. A stopper 726 is fixed on the round rack 725 so that it is capable of sliding only downward from the position of contact with the correction block 724. With this arrangement, the axis-to-axis distance r' between the rotational shaft 717 and the shaft 723 can be controlled in accordance with the rotation of the pulse motor 728 and it is also possible to control the axis-to-axis distance r between the abrasive wheel rotating shaft 61*a* and each of the lens rotating shafts 704*a* and 704*b* since r has a linear correlationship with r'.

A sensor 727 is provided on the intermediate plate 710 to confirm the contact between the stopper 726 and the correction block 724, thereby checking the state of grinding on the lens. One end of a spring 731 is hooked on the drive plate 716 and the other end thereof is hooked on a wire 732. A drum is mounted on the rotation shaft of a motor 733 fixed on the intermediate plate 710, so that by winding up the wire 732 the processing pressure of the lens LE to the abrasive wheel group 60 can be varied.

The arrangement of the carriage section of the present invention is basically the same as that described in the commonly assigned U.S. Pat. No. 5,347,762, to which the reference should be made.

(B) Display Section and Input Section

Figure 4:
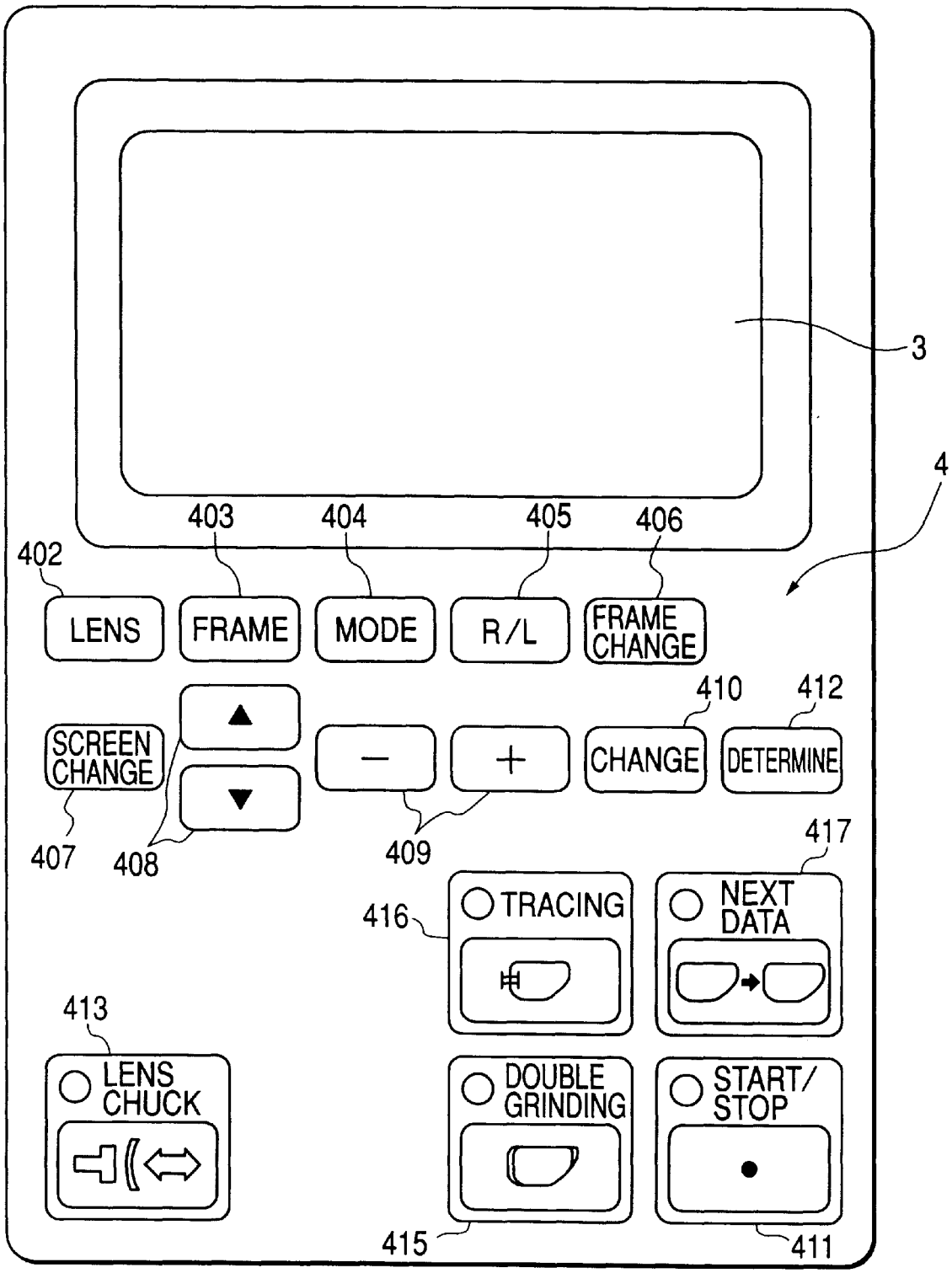
FIG. 4 is a diagram showing the exterior appearance of a display section and an input section.

FIG. 4 is a diagram showing the outer appearance of the display section 3 and the input section 4. The display section 3 is formed of a liquid-crystal display and, under the control of a main arithmetic control circuit to be described later, it displays, for example, a parameter setting screen, a layout screen with which layout information can be input, and a bevel simulation screen on which the position of a bevel with respect to the target lens configuration and the cross-sectional condition of the bevel are simulated.

The input section 4 includes various setting switches such as a lens switch 402 for instructing the constituent material (plastic, polycarbonate or glass) of the lens to be processed, a frame switch 403 for distinguishing between plastic and metal as the constituent material of the frame, a mode switch 404 for selecting the mode of lens processing to be performed (whether it is bevel processing, bevel polishing, plane processing or plano-polishing), a R/L switch 405 for determining whether the lens to be processed is for use on the right eye or the left eye, a screen change switch 407 for selecting a screen to be displayed on the display section 3 (the layout screen, the menu screen or the parameter setting screen), move switches 408 for moving a cursor or arrow displayed on the display section 3 to thereby select items to be input, "−" and "+" switches 409 for numerical data input, a change switch 410 used to change the input manner of the layout data, a START/STOP switch 411 for starting or stopping the lens processing operation, a switch 413 for opening or closing the lens chucks, a tracing switch 416 for giving an instruction to trace the eyeglass frame or template, and a next-data switch 417 for transferring the data thus obtained by the tracing.

(C) Electronic Control System for the Apparatus

Figure 6:
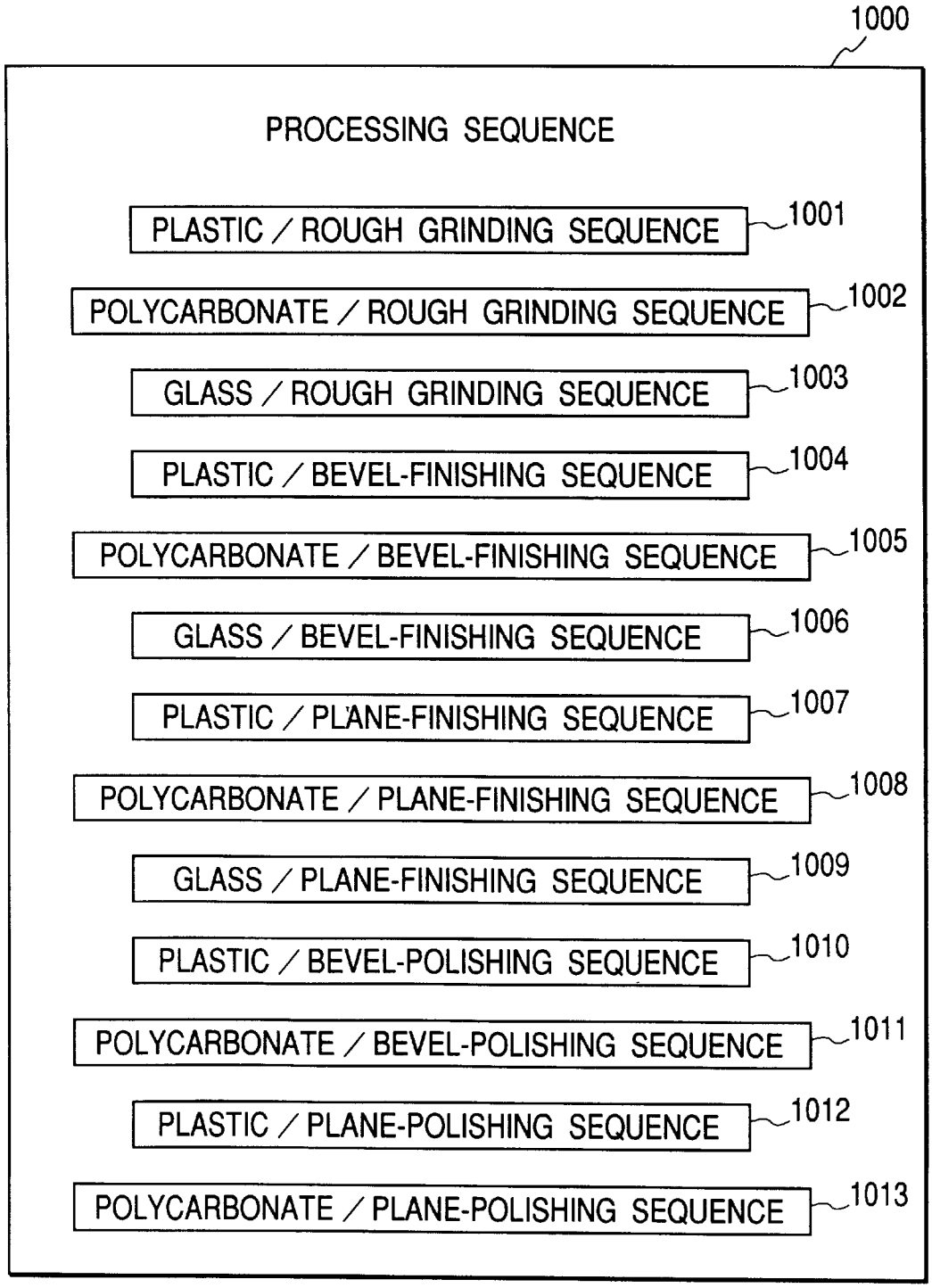
FIG. 6 is a diagram showing the processing sequence stored in a main program memory.

FIG. 5 shows the essential part of a block diagram of the electronic control system for the eyeglass lens grinding apparatus of the invention. A main arithmetic control circuit 100 which is typically formed of a microprocessor and controlled by a sequence program stored in a main program memory 101. As a processing sequence program 1000, thirteen types are preliminary prepared, i.e. processing sequence programs 1001 to 1009 for rough processing, bevel-finishing, and plane processing operations each on plastic, polycarbonate and glass lenses, and sequence programs 1010 to 1013 for polished-bevel and polished-plane processing operations each on the plastic and polycarbonate lenses (see FIG. 6). Each of the sequence programs 1001 to 1013 is programmed so that the direction and speed of the lens rotation, processing pressure, and so on are changed depending on a kind of the lens even in the same type of processing, and thus can carry out the most suitable processing.

Data on types of abrasive wheel arrangements and positions of respective abrasive wheels, on lens processing size adjustment and bevel-position adjustment, and so on are stored in a parameter memory 105. The main arithmetic control circuit 100 controls processing based on parameter data stored in the parameter memory 105 and the selected processing sequence.

The main arithmetic control circuit 100 can exchange data with IC cards, eye examination devices and so forth via a serial communication port 102. The main arithmetic control circuit 100 also performs data exchange and communication with a tracer arithmetic control circuit 200 of the eyeglass frame and template configuration measurement section 2. Data on the eyeglass frame configuration are stored in a data memory 103.

The display section 3, the input section 4, a sound reproducing device 104 and the lens configuration measuring section 5 are connected to the main arithmetic control circuit 100. The measured data of lens which have been obtained by arithmetic operations in the main arithmetic control circuit 100 are stored in the data memory 103. The carriage moving motor 714, as well as the pulse motors 728 and 721 are connected to the main arithmetic control circuit 100 via a pulse motor driver 110 and a pulse generator 111. The pulse generator 111 receives commands from the main arithmetic control circuit 100 and determines how many pulses are to be supplied at what frequency in Hz to the respective pulse motors to control their operation.

Next, the procedure of setting a processing sequence in accordance with a specific arrangement of abrasive wheels will be described. There are representative types of wheel arrangements, and the respective abrasive wheels are arranged according to each of such representative types. For example, four wheels are arranged as shown in FIG. 1 and a processing sequence is set in accordance with this four-wheel arrangement. The switch 407 is depressed to retrieve a menu display on the display section 3 and an item on system setting is retrieved from the displayed menu items. Then, the display section 3 shows a display of "SYSTEM SETTING MODE" which is indicated by 300 in FIG. 7. The MOVE switches 408 are selectively depressed to move an arrow 302 to point an item of "SYSTEM MODE" 301, and TYPE 2 is selected by manipulation of the switch 409. Successive pressing of the switch 409 causes changes from TYPE 1 through TYPE 2 to TYPE 3, and the respective TYPES are associated with the representative wheel arrangements. TYPE 1 corresponds to the standard three-wheel arrangement and TYPE 2 corresponds to the four-wheel arrangement shown in FIG. 1. TYPE 3 corresponds to a three-wheel array consisting of a rough abrasive wheel for use on plastic lenses, a finishing abrasive wheel for bevel and plane processing operations, and a polishing abrasive wheel for polished-bevel and polished plane processing operations.

When the type of a specific wheel arrangement is designated, the arrow 302 is adjusted to point an item of "WHEEL PARAMETER" 303, and the CHANGE switch 410 is depressed to retrieve a wheel parameter setting display. Then, the display section 3 shows a display that permits the wheel positions to be set in accordance with the abrasive wheels in the four-wheel arrangement (TYPE 2) in FIG. 8. The arrow 302 is moved to designate each of the items for the respective wheels where the numeral value 305 displayed on the right of each item is altered by manipulation with the switches 409 so as to enter the mounting position of each wheel. Specifically, the mounting position of each wheel, in this case, is a distance between a position of the lens being subjected to processing by the each wheel and a certain reference point on the axis of the rotating shaft 61*a*. Since the thickness of each wheel, the bevel position and certain other parameters are already known, the time to enter position information on these parameters may be saved by preliminary storage in the parameter memory 105 in accordance with different types of wheel arrangements.

By initializing the display on the display section 3, the parametric values for each of the wheel arrangement types stored in the parameter memory 105 are rewritten.

Based on these settings of wheel arrangement and the mounting positions of the respective wheels, the main arithmetic control circuit 100 determines an applicable process sequence program as selected from within the main program memory 101. The abrasive wheels are closely related to the processing sequences, so if tables are preliminary prepared that relate information on the respective wheel arrangements and the mounting positions (processing positions) of the individual wheels to the processing sequences which are applicable to specific wheels, there is no need to prepare software programs for the respective wheel arrangements. FIG. 9 shows a table for TYPE 2 corresponding to the four-wheel arrangement. The "WHEEL POSITION" in the table is keyed to the numeral values stored in the parameter memory 105.

Figure 10:
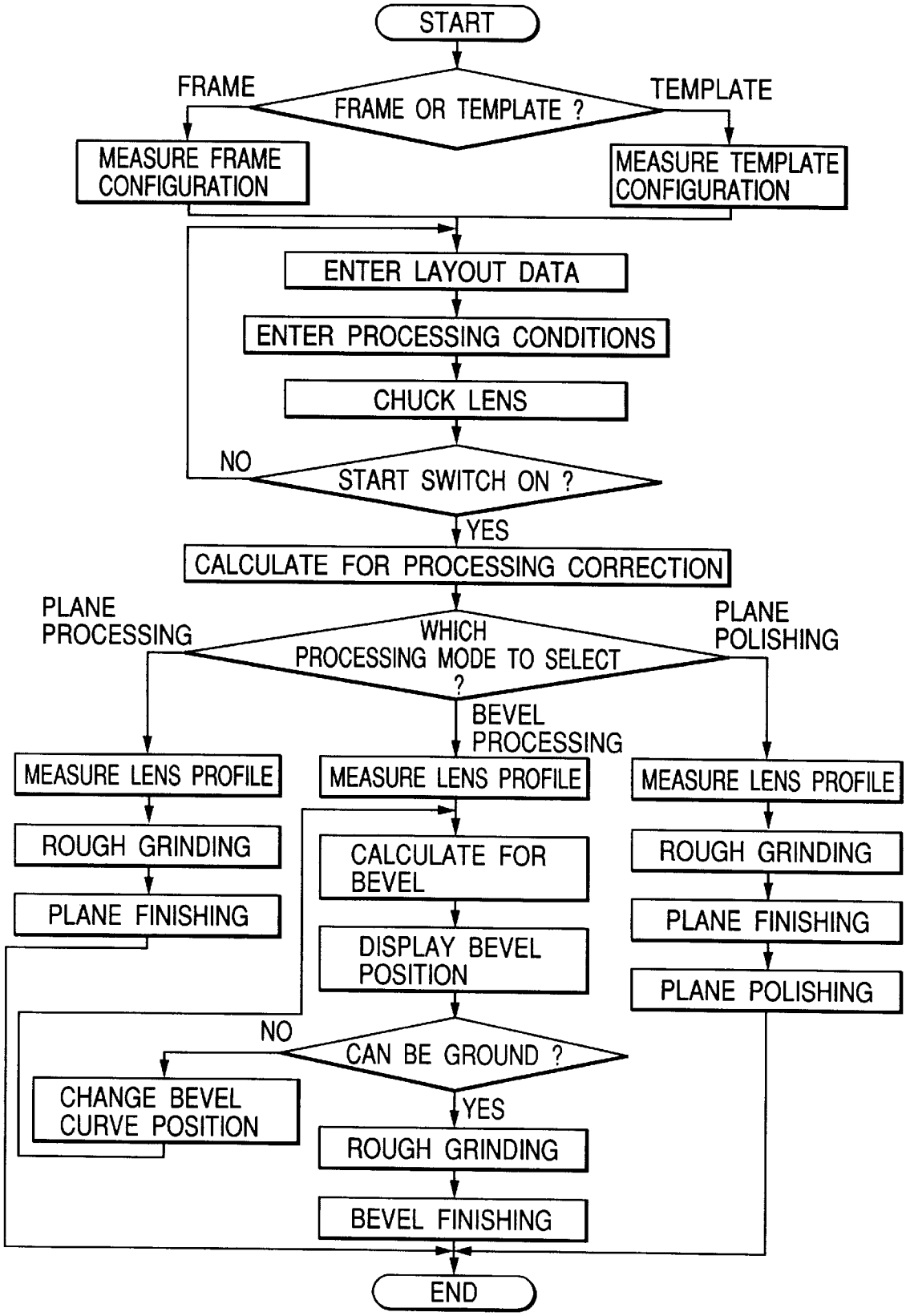
FIG. 10 is a flowchart for illustrating the lens grinding operation to be performed by the apparatus shown in FIG. 1.

Next, the description will be made as to how the grinding apparatus of the invention performs in the actual processing operation (see FIG. 10). First, the eyeglass frame and template configuration measuring section 2 is used to trace an eyeglass frame (or template therefor) to obtain eyeglass frame data and, thereafter, the input section 4 is manipulated to enter layout data such as the pupillary distance of the user (PD), the distance between the centers of the eyeglass frame (FPD), the height of the optical center and so on. Subsequently, the operator determines and enters processing conditions such as the material of lens to be processed, the material of the frame, whether the lens to be processed is for use on the right or left eye and in which mode the lens processing is to be performed.

After the processing conditions are entered, the lens to be processed is chucked between the lens rotating shafts 704*a* and 704*b*, and the START/STOP switch 411 is depressed to turn on the apparatus. In response to the entry of the START signal, the apparatus performs processing correction and other arithmetic operations necessary to process the lens into the shape represented by radius vector information, and subsequently it turns on the lens configuration measuring section 5 to measure the lens configuration (for details about the processing correction and the measurement of the lens configuration, see U.S. Pat. No. 5,347,762). In a bevel processing mode, if data on the lens configuration (the edge position) is obtained, bevel calculations are performed to determine the position of the bevel apex on the basis of that information and, as a result, the necessary bevel processing data is obtained.

When the necessary preliminary steps are complete, lens processing is executed on the basis of the processing data in accordance with a processing sequence associated with the selected processing mode. First, rough grinding is executed. If the material of the lens is designated as plastic or polycarbonate, the carriage 700 is moved such that the lens is confronted with the rough abrasive wheel 60*a* for use on plastic lenses; if the material of the lens is designated as glass, the carriage 700 is moved such that the lens is confronted with the rough abrasive wheel 60*b* for use on glass lenses. The position to which the lens is to be moved is controlled on the basis of information on the wheel mounting position preliminary set. Subsequently, according to the rough grinding sequence depending on the designated material of the lens, rough grinding of the lens is performed with the rotating action of the lens rotating shafts and the pivoting action of the carriage 700 being controlled on the basis of the information on processing correction.

When the rough grinding step ends, the process goes to the finishing step. In a bevel processing mode, the lens is positioned to contact the bevel groove on the finishing abrasive wheel 60*c*. In a plane processing mode, the lens is moved to contact the flat portion of the wheel 60*c*. As in the case of finishing-grinding, the position to which the lens is to be moved is controlled on the basis of information on the-set wheel mounting position. According to the finishing sequence depending on the designated material of the lens and the designated processing mode, the apparatus controls the drive of the associated motors to perform finish-grinding of the lens.

In the polished-plane processing mode, the process subsequently goes to the polishing step. Based on the information about the set mounting position of the polishing abrasive wheel 60*d* for polished-plane processing operations, the apparatus moves the lens to be confronted with the plano-polishing abrasive wheel 60*d* and controls the drive of the associated motors to perform polished-plane processing on the lens by grinding its periphery based on the polished-plane processing data.

The sequence of lens processing according to the invention has been described above with reference to the case of using a four-wheel arrangement consisting a rough abrasive wheel for use on plastic lenses, a rough abrasive wheel for use on glass lenses, a finishing abrasive wheel and a plane-polishing abrasive wheel. One great advantage of the invention is that change to a different wheel arrangement can be easily accomplished without changing the software program. If it is desired to change to the wheel arrangement of TYPE 3, the following procedure may be employed. First, as in the case of TYPE 2, a display of "SYSTEM SETTING MODE" 300 (see in FIG. 7) is retrieved on the display section 3 and the wheel arrangement in item 301 is readjusted to TYPE 3. Then, item of "WHEEL PARAMETER" 303 is selected and a wheel parameter setting display is retrieved, followed by the entry of the wheel positions. The parametric values to be entered in this case are the following: the position of processing with the rough abrasive wheel for use on plastic lenses, the positions of bevel-processing and plane-processing with the finishing abrasive wheel, and the positions of bevel-processing and the plane-processing with the polishing abrasive wheel. Thus, it becomes possible to perform lens processing according to the sequence associated with the new wheel arrangement.

As another advantage, the current abrasive wheel can be easily replaced by an abrasive wheel of a different thickness by inputting information about the processing position that matches with the thickness of the new abrasive wheel.

It should be noted here that individual abrasive wheels have their own dimensional errors that may be introduced during lens processing, and mere replacement of one abrasive wheel with another can potentially cause an error in the size of the processed lens or its bevel position. In order to avoid this problem, wheel replacement should be accompanied by changes in the parameters for readjusting the lens size and the bevel position. When readjusting the lens size, an item of "SIZE ADJUSTMENT" is selected from a menu display and parameter setting display for size adjustment is retrieved as shown in FIG. 11. The switches 408 are selectively depressed to point the arrow 302 to the parameter to be altered and the switches 409 are manipulated to increment or decrement the numeral values displayed on the right of the screen. Then, CHANGE switch 410 is depressed to rewrite the reference values in the parameter memory 105 with the thus set numeral values. After initializing the display, trial processing is done to check the size of the lens after processing. This procedure is repeated until the size of the lens after processing is found appropriate, whereupon the size adjustment step is complete. When readjusting the bevel position of the lens, a parameter setting display is retrieved as shown in FIG. 12. Again the arrow 302 is moved to designate the item to be altered and the numeral values displayed on the right of the screen are adjusted to thereby rewrite the reference values in the parameter memory 105 that are associated with the bevel position; thereafter, trial processing is done until the appropriate bevel position is obtained.

The adjusted parameters are stored in the parameter memory 105 independently for each type of wheel arrangement, so once the necessary adjustments are made, there is no need to perform the same adjustments in the second and subsequent cycles of processing operations.

Thus, according to the invention, changes in wheel arrangement can be easily accomplished on the same software program, and the operator of the lens grinding apparatus, if having the abrasive wheels of the standard three-wheel arrangement and an abrasive wheel capable of polishing, can perform the desired polishing of a lens by merely substituting the polishing abrasive wheel and altering the settings of the necessary parameters.

As described on the foregoing pages, there is provided an eyeglass lens grinding apparatus that is adapted to be operable with different arrangements of abrasive wheels using a smaller number of software programs that have to be made available separately and which can be managed easily. The apparatus is also adapted to provide ease in performing different types of lens processing by changing one wheel alarrangement to another.

What is claimed is:

1. An eyeglass lens grinding apparatus for grinding an eyeglass lens so that it conforms to a shape of an eyeglass frame, said apparatus comprising:

processing sequence storing means for storing a group of processing sequences that are classified in terms of materials of lenses and contents of processing and that are optimized for respective materials and contents;

information input program storing means for storing an information input program which inputs abrasive wheel information relating to an arrangement of abrasive wheels mounted on an abrasive wheel shaft and to a kind and a position of each of the abrasive wheels mounted on the abrasive wheel shaft which are selected from a group of mountable abrasive wheels;

abrasive wheel information input means for inputting the abrasive wheel information;

processing sequence determining means for obtaining applicable processing sequences from the group of processing sequences based on (1) the abrasive wheel information, (2) a material of a subject lens, and (3) a processing condition including a processing mode, which are inputted by an operator, whereby a processing control program for the apparatus is given to control processing using data including layout data of the subject lens with respect to an eyeglass frame.

2. An eyeglass lens grinding apparatus according to claim 1, wherein said processing sequence determining means has a table that relates to the information about the arrangement of abrasive wheels and their mounting positions to the applicable processing sequence, and the input of the abrasive wheel information is carried out based on the input of the arrangement of the abrasive wheels.

3. An eyeglass lens grinding apparatus according to claim 1, further comprising:

parameter storage means for storing types of abrasive wheels and parametric values for their mounting positions, in relation to each of wheel arrangement types, wherein said input means includes:

type designating means for designating a wheel arrangement type; and parameter changing means for changing the parametric values stored in said parameter storage means for the designated wheel arrangement type, and wherein said processing sequence determining means determines the applicable processing sequence in association with the wheel arrangement type and parametric values stored in said parameter storage means.

4. An eyeglass lens grinding apparatus for grinding an eyeglass lens so that it conforms to a shape of an eyeglass frame, said apparatus comprising:

processing sequence storing means for storing a group of processing sequences that are classified in terms of materials of lenses and contents of processing and that are optimized for respective materials and contents;

abrasive wheel arrangement storing means for storing arrangement types of abrasive wheels mountable to an abrasive wheel shaft;

relationship storing means for storing therein positional information of the abrasive wheels and processing sequences applicable to the abrasive wheels in relation to the arrangement types of the abrasive wheels;

abrasive wheel arrangement selecting means for selecting an arrangement type of abrasive wheel mounted to the abrasive wheel shaft; and processing sequence determining means for obtaining applicable processing sequences from the group of sequences based on (1) the arrangement type selected by the selecting means, (2) a material of a subject lens, and (3) a processing condition including a processing mode, which are inputted by an operator, whereby a processing control program for the apparatus is given to control processing using data including layout data of the subject lens with respect to an eyeglass frame.

5. An eyeglass lens grinding apparatus according to claim 4, further comprising:

input means for inputting parameters for correcting dimensional errors of the abrasive wheels mounted on the abrasive wheel shaft.

* * * * *